United States Patent [19]

Nogi et al.

[11] Patent Number: 5,027,778

[45] Date of Patent: Jul. 2, 1991

[54] FUEL INJECTION CONTROL APPARATUS

[75] Inventors: Toshiharu Nogi, Katsuta, Japan; Teruo Yamauchi, Farmington Hills, Mich.; Yoshishige Ohyama, Katsuta, Japan

[73] Assignee: Hitachi, Ltd., Tokyo, Japan

[21] Appl. No.: 430,254

[22] Filed: Nov. 2, 1989

[30] Foreign Application Priority Data

Nov. 16, 1988 [JP] Japan ..... 63-287748

[51] Int. Cl.[5] ..... F02M 51/00

[52] U.S. Cl. ..... 123/472; 123/531

[58] Field of Search ..... 123/531, 533, 590, 472, 123/585; 239/406, 408

[56] References Cited

U.S. PATENT DOCUMENTS

| | | | |
|---|---|---|---|
| 1,901,848 | 3/1933 | Moore | 123/531 |
| 3,831,854 | 8/1974 | Sato et al. | 239/406 |
| 4,105,163 | 8/1978 | Davis et al. | 239/406 |
| 4,168,803 | 9/1979 | Simmons et al. | 239/406 |
| 4,257,376 | 3/1981 | Wen | 123/472 |
| 4,325,341 | 4/1982 | Yamauchi et al. | 123/472 |
| 4,342,443 | 8/1982 | Wakeman | 123/472 |

*Primary Examiner*—Andrew M. Dolinar
*Assistant Examiner*—M. Macy
*Attorney, Agent, or Firm*—Antonelli, Terry, Stout & Kraus

[57] ABSTRACT

An air injector is provided in the vicinity of a fuel injector. By the fuel injector and the air injector, the droplet diameter of a gasoline spray included an air-fuel mixture supplied to a cylinder of the engine is controlled. When the fuel injector is operated during a suction stroke of a gasoline engine, the droplet diameter of the gasoline spray supplied to a portion if the cylinder in a vicinity of a discharge electrode of a spark plug is controlled to have a predetermined value, such as substantially 40 μm. Since the droplet diameter of the gasoline spray is controlled voluntarily, the air-fuel mixture of the gasoline spray size having a good ignition characteristic property is distributed selectively in the vicinity of the discharge electrode of the spark plug. A stable ignition condition for the engine is maintained without the occurrence of knocking, and an engine having a high thermal efficiency is obtained.

26 Claims, 10 Drawing Sheets

FUEL INJECTION CONTROL APPARATUS

BACKGROUND OF THE INVENTION

The present invention relates to a fuel injection control apparatus for use in a fuel injection system of an internal combustion engine and, more particularly, to a fuel injection control apparatus suitable for use in an electronic fuel injection system for an automotive gasoline engine.

In an internal combustion engine, such as a gasoline engine etc., an attempt for obtaining a high compression ratio for the engine is effective in providing an improved thermal efficiency in operation of the engine. However, the attempt for obtaining a high compression ratio for the engine is accompanied by a problem of knocking.

Up to now, there have been tried various proposals an techniques which attempt to heighten the compression ratio for the engine without creating knocking. For example, there has been known a method in which the knocking occurrence is maintained at a critical condition by controlling the ignition time using a knock sensor.

Further, there has been known a method in which the air-fuel mixture ratio (air-fuel ratio (A/F)) is maintained at the rich side at a surrounding portion of a spark plug by controlling the air-fuel mixture ratio distribution in the cylinder. This latter stated technique is disclosed, for example, in Japanese Patent Laid-Open Publication No. 179328/1982.

As is generally known, knocking in an internal engine combustion results from a phenomenon in which a wall surface of some portion of an inner surface in a combustion chamber, such as a wall surface of the cylinder or an upper surface of the piston, is ignited prior to the ignition of the air-fuel mixture by the spark plug. To avoid this problem, it is effective to lower the ignition characteristic property of the air-fuel mixture.

Besides, from an aspect of stabilization of the combustion of the engine, it is desirable to improve the ignition characteristic property of the air-fuel mixture. When the combustion for the engine is unstable, the combustion efficiency for the engine becomes lower, and the fuel consumption for the engine becomes lower also.

Regarding the above stated conventional techniques concerning fuel injection control, there is a problem in attaining a desired combustion efficiency for the engine at the ignition time, and further there is no consideration is given to the complicated air-fuel ratio (A/F) control accompanying the control for the air-fuel mixture distribution.

In the fuel injection system for a gasoline engine, the fuel included in the air-fuel mixture is constituted mainly, of a gasoline spray which floats in air in the cylinder in a droplet state, or in the state of a gasoline spray.

SUMMARY OF THE INVENTION

An object of the present invention is to provide a fuel injection control apparatus wherein an anti-knocking characteristic property for an internal combustion engine can be obtained effectively.

Another object of the present invention is to provide a fuel injection control apparatus wherein a high thermal efficiency for an internal combustion engine can be attained effectively while restraining the occurence of knocking.

A further object of the present invention is to provide a fuel injection control apparatus wherein a high compression ratio for an internal combustion engine can be obtained effectively while restraining the occurence of knocking.

A further object of the present invention is to provide a fuel injection control apparatus wherein a stable combustion for an air-fuel mixture can be obtained effectively while restraining the occurence of knocking.

A further object of the present invention is to provide a fuel injection control apparatus wherein a stable ignition condition can be obtained effectively.

A further object of the present invention is to provide a fuel injection control apparatus wherein the distribution of the droplet size of a gasoline spray can be controlled voluntarily.

A further object of the present invention is to provide a fuel injection control apparatus wherein the distribution of the droplet size of a gasoline spray can be controlled selectively in regard to a specific portion of a combustion chamber in an internal combustion engine.

In accordance with the present invention, in a fuel injection control apparatus for use in a fuel injection system of an internal combustion engine, various data indicating an operational condition of the internal combustion engine are received in a control unit, a predetermined calculation is carried out in the control unit in accordance with various data, a necessary fuel injection amount is calculated in the control unit, and the fuel injection amount is supplied into a cylinder of the internal combustion engine through a fuel injector.

The fuel injection control apparatus for use in a fuel injection system of an internal combustion engine includes a fuel spray size distribution control means for controlling the distribution of the spray size of a fuel in the air-fuel mixture in the cylinder, and the fuel spray size distribution control means controls the spray size of the fuel in the air-fuel mixture in the vicinity of the spark plug disposed in the cylinder at a predetermined value.

Above stated objects of the present invention are attained is consideration of the above stated phenomenon by controlling the droplet size (droplet diameter) distribution in the fuel spray in the cylinder or the droplet size distribution in the droplet state fuel in the cylinder.

Mainly, in the air-fuel mixture including the fuel spray, the ignition characteristic property is varied in accordance with the droplet size (droplet diameter) of the fuel spray, for example, the ignition characteristic property is improved remarkably at a predetermined value of the droplet diameter, such as about 40 $\mu$m.

According to the present invention, through the control of the droplet size distribution of the fuel in the cylinder, it is possible to carry out the following control method in which, the ignition characteristic property for the air-fuel mixture is increased only in the vicinity of the spark plug, and besides, at the vicinity surrounding the surface of the cylinder or the upper surface of the piston, the ignition characteristic property of the air-fuel mixture is made lower, with the results that the compression ratio for the engine can be raised effectively while restraining the occurence of knocking.

According to the present invention, since the droplet size distribution of the fuel spray in the fuel injection control apparatus can be controlled voluntarily in the cylinder, an air-fuel mixture having a fuel spray size which provides a good ignition characteristic property can be distributed selectively at the vicinity of the discharge electrode of the spark plug, and also the air-fuel mixture having a fuel spray size with a bad ignition characteristic property can be distributed selectively in the vicinity of the wall surface of the combustion chamber, spaced from the vicinity of the discharge electrode of the spark plug.

Therefore, even if the compression ratio for the engine is increased, a stable ignition condition can be maintained effectively, a knocking phenomenon does not occur, and an internal combustion engine having the high thermal efficiency in the fuel injection control apparatus can be obtained easily.

DESCRIPTION OF THE INVENTION

Figure 1:
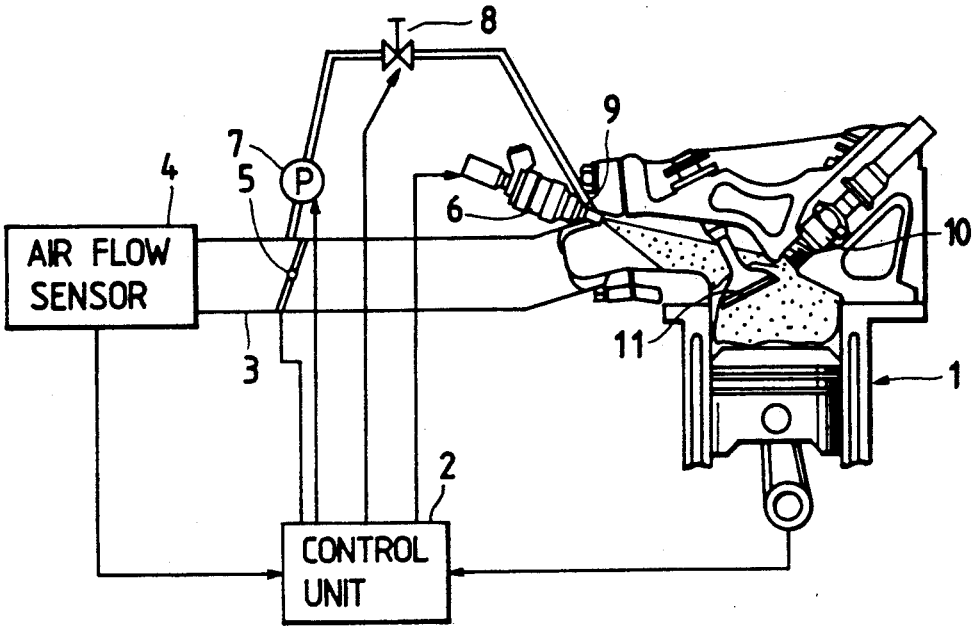
FIG. 1 is a structural view showing one embodiment of a fuel injection control apparatus according to the present invention.

One embodiment of a fuel injection control apparatus according to the present invention will be explained in detail referring to the drawings.

FIG. 1 shows one embodiment of a fuel injection control apparatus according to the present invention. In FIG. 1, a fuel injection control apparatus includes an internal combustion engine 1 such as a gasoline engine and a control unit 2 having a micro-processing unit therein.

The engine 1 includes an intake manifold 3, and an air flow sensor 4 disposed on the intake manifold 3. Further, various detecting sensors in addition to the air flow sensor 4 for detecting an intake air flow amount are disposed on the engine 1, such as a throttle valve opening degree detecting sensor disposed on a shaft of a throttle valve 5, a rotation detecting sensor disposed on a crank shaft, a water temperature detecting sensor for detecting coolant temperature in the engine 1, and an $O_2$ sensor (oxygen concentration detecting sensor) disposed in an exhaust manifold.

The control unit 2 takes in various data therein, representing the operational conditions of the engine 1, through the above stated various detecting sensors. Namely, the control unit 2 takes in various data, for example, an intake air flow amount $Q_a$ through the air flow sensor 4, a throttle valve opening degree $\theta_{th}$ through the throttle valve opening degree detecting sensor, an engine rotating speed N through the rotation detecting sensor, an engine temperature $T_w$ through the water temperature detecting sensor, and an air-fuel ratio (A/F) signal (rich or lean) through the $O_2$ sensor, etc.

In accordance with the above stated various data, a predetermined calculation processing is carried out in the micro-processing unit of the control unit 2, a necessary fuel injection pulse width $T_i$ is calculated, and this fuel injection pulse width $T_i$ is supplied into a fuel injector 6, whereby the engine 1 is controlled so as to obtain a predetermined air-fuel ratio (A/F).

The fuel injection control apparatus comprises further an air pump 7, an electro-magnetic air valve 8, and an air nozzle 9. These apparatuses work so as to inject again the air which is taken in an upper-stream of the throttle valve 5 disposed in the intake manifold 3, through the air nozzle 9 at a predetermined air injection timing. The fuel injection control apparatus comprises further a spark plug 10 and an air intake valve 11.

Figure 2A:
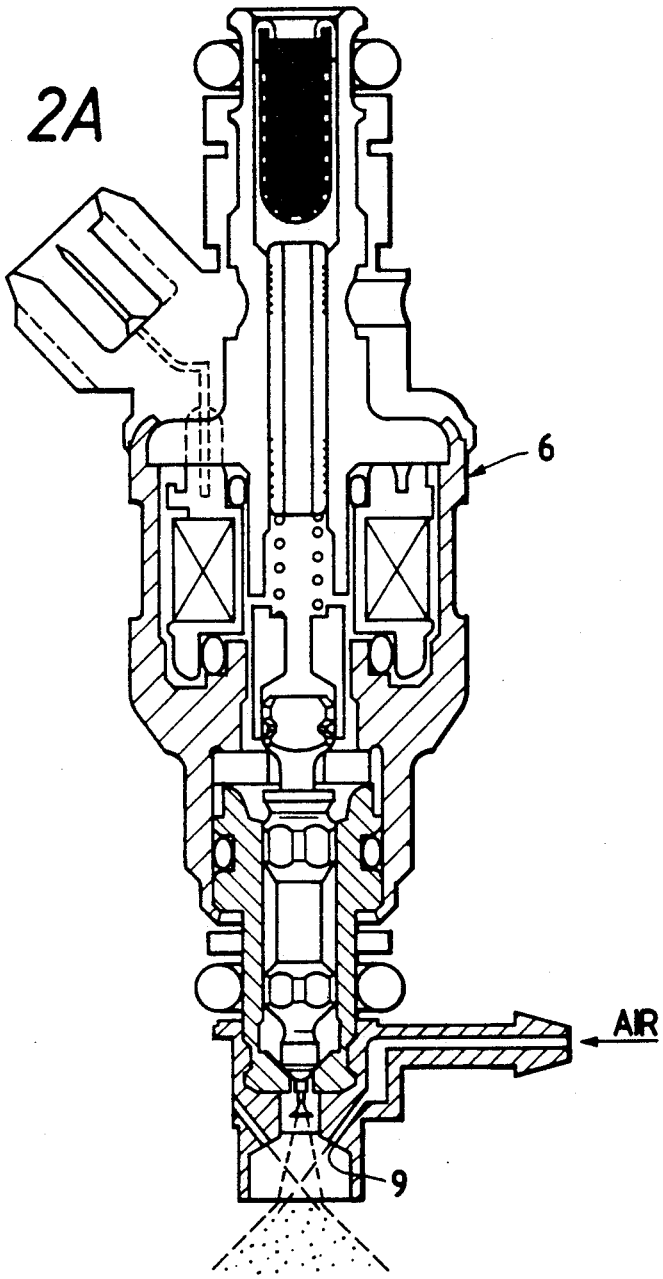
FIG. 2A is a cross-sectional view showing one embodiment of a fuel injector for use in a fuel injection control apparatus according to the present invention.
Figure 2B:
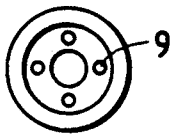
FIG. 2B is a bottom view showing one embodiment of a fuel injector for use in the fuel injection control apparatus according to the present invention.

In this time, since the air nozzle 9 is arranged in the vicinity of an injecting nozzle of the fuel injector 6, as shown in FIG. 2, this air nozzle 9 is mounted so as to blow the air against the fuel which is injected from the fuel injector 6.

When the electro-magnetic air valve 8 is opened and then air is injected from the air nozzle 9, this injected air collides with the droplets of the fuel, which are injected from the fuel injector 6, and works so as to make the droplet size of the gasoline spray smaller.

Next, the operation of this embodiment of the fuel injection control apparatus according to the present invention will be explained as follows.

Figure 3:
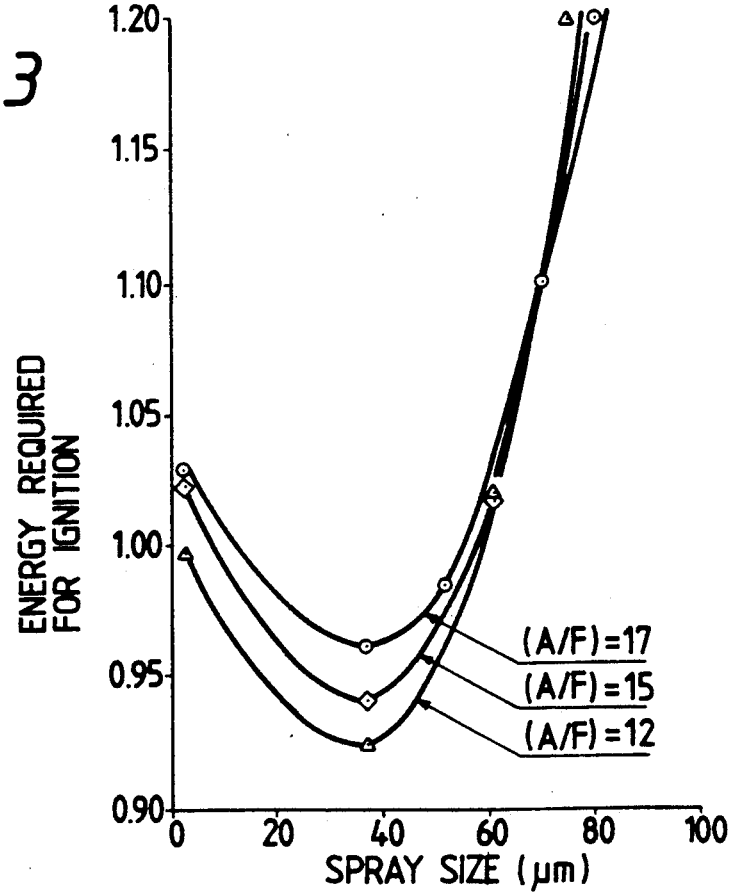
FIG. 3 is a characteristic view showing a relationship between the droplet size of a gasoline spray and the energy required for ignition.

First of all, FIG. 3 is a characteristic diagram showing a relationship between the droplet size (spray size) of a liquid state gasoline in the air-fuel mixture including the gasoline spray and the ignition energy necessary of ignition for the liquid state gasoline. As shown clearly in FIG. 3, the ignition energy presents a minimum value at a droplet size of about 40 μm, regardless of the concentration of the air-fuel mixture (in other words, the air-fuel mixture ratio, or the air-fuel ratio (A/F)), which are (A/F)=12, (A/F)=15, and (A/F)=17, for example.

Figure 4:
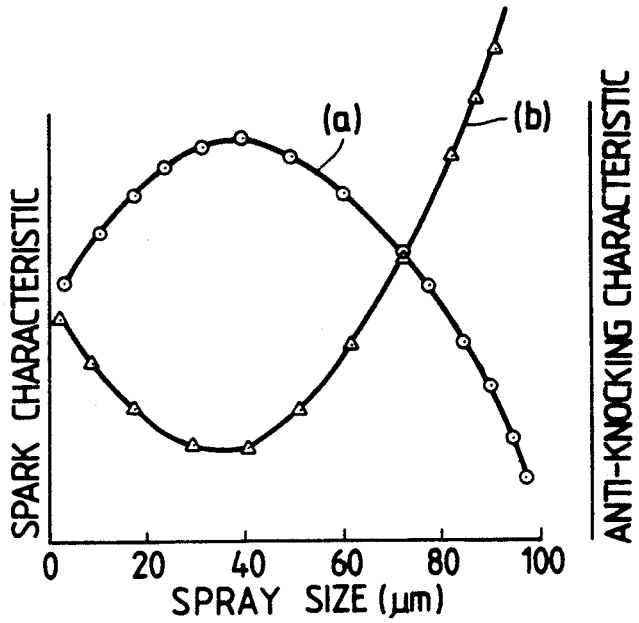
FIG. 4 is a characteristic view showing a relationship between the droplet size of a gasoline spray and a spark characteristic and also a characteristic view showing a relationship between the droplet size of the gasoline spray and an anti-knocking characteristic.

Besides, the smaller the ignition energy is, the easier it is for the spark ignition to be easily carried out. FIG. 4 is a characteristic diagram showing a relationship between the spark characteristic with the spray size of the fuel and the anti-knocking characteristic with the spray size of the fuel.

As shown clearly in FIG. 4, it is known that the ignition is carried out easily with a gasoline spray having a droplet diameter of substantially 40 μm as shown by the curved line (a), while knocking also occuring easily with this gasoline spray having a droplet diameter of substantially 40 μm as shown by the curved line (b). As a result, so as to restrain the occurrence of knocking, it is known that it is desirable to enlarge the gasoline spray so as to have a droplet diameter of substantially more than 100 μm.

Accordingly, in this embodiment of the present invention, since both the fuel injection timing through the fuel injector 6 and the air injection timing through the electro-magnetic air valve 8 are controlled respectively by the control unit 2, the distribution of the gasoline spray size in the cylinder of the engine 1 can be controlled.

In the spark timing, in the vicinity of the discharge electrode of the spark plug 10, the gasoline spray having a droplet diameter of about 40 μm exists, and at a part remote from the discharge electrode of the spark plug 10, a gasoline spray having a droplet diameter of substantially 40 μm exists.

An above stated control method in this embodiment of the fuel injection control apparatus will be explained concretely using various timing charts shown in FIG. 5.

As known already, in the gasoline engine having four strokes, one time combustion cycle comprises four strokes which are a suction stroke, a compression stroke, a combustion stroke, and an exhaust stroke. In the common reciprocating engine, this cycle is carried out repeatedly at every two rotations.

Herein, in case of the suction stroke, since the air-fuel mixture is taken in the cylinder, the air flow velocity in the intake manifold 3 increases. So, the fuel is injected according to a fuel injection timing chart when the air intake valve 11 is opened according to an air injection timing chart shown in FIG. 5, the air including the gasoline spray is taken rapidly into the cylinder.

Further, the droplet size of the gasoline spray, which is injected through the fuel injector 6, is adjusted to have a comparatively large value, for example of about 100 μm. On the other hand, when the electro-magnetic air valve 8 is opened and the air is injected through the air nozzle 9 according to the air injection timing chart shown in FIG. 5, the droplet size of the gasoline spray is made small, as stated above.

Figure 5:
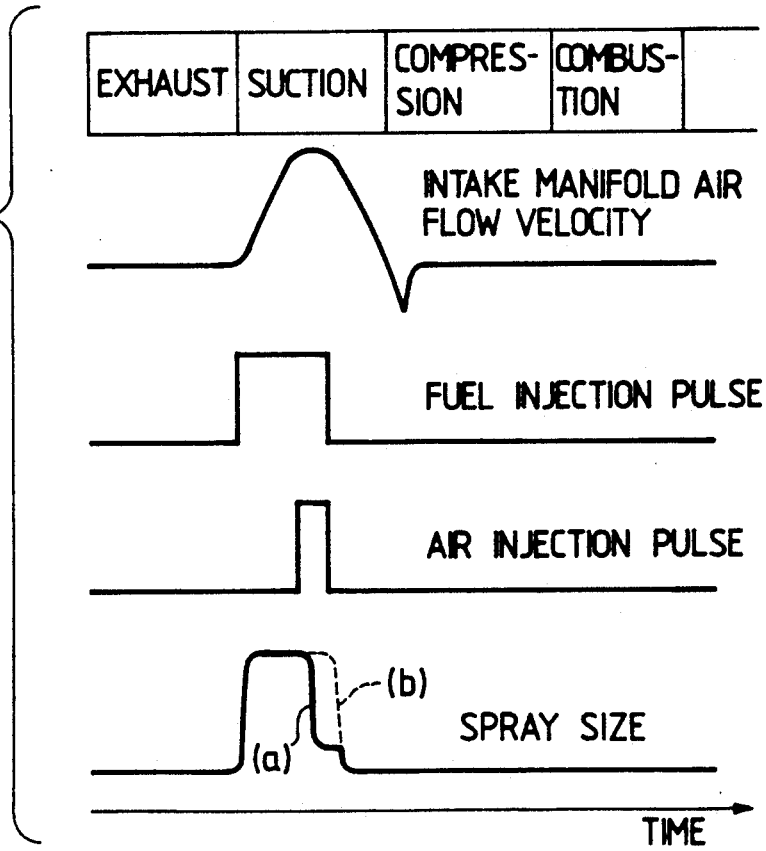
FIG. 5 shows various timing charts for explaining an operation of another embodiment of a fuel injection control apparatus according to the present invention.

Accordingly, in this embodiment of the present invention, as shown in FIG. 5, at the suction stroke when the intake air flow velocity is large, the fuel injector 6 is opened, and also, at the latter half of the opening valve time of the fuel injector 6, the electro-magnetic air valve 8 is opened further. And only when the electro-magnetic air valve 8 is opened, the droplet size of the gasoline spray, which is injected through the fuel injector 6, is adjusted to have a predetermined small value, for example substantially 40 μm.

In the gasoline spray size in FIG. 5, a solid curve line (a) indicates the gasoline spray size in the present invention, and a dot curve line (b) indicates the gasoline spray size in the conventional fuel injection control apparatus.

Accordingly, in this embodiment of the present invention as shown in FIG. 1, the control for the following droplet size distribution of the gasoline spray can be obtained. Namely, at the vicinity of the spark plug 10 in the cylinder of the engine 1, an air-fuel mixture having a droplet size of substantially 40 μm in the gasoline spray and having an easy ignition characteristic property can exist, and at the portion other than the above stated vicinity of the spark plug 10, an air-fuel mixture having a droplet size of more than 100 μm in the gasoline spray and having a difficult ignition characteristic property can exist.

As a result, as shown in FIG. 3 and FIG. 4, the combustion for the engine 1 having a suitable air-fuel mixture can be obtained while restraining with certainty the occurrence of knocking, and accordingly it is possible to attain effectively a high compression ratio for the engine 1, and further it is possible to improve and obtain easily a high thermal efficiency for the engine 1.

Next, another embodiment of the fuel injection control apparatus according to the present invention will be explained in detail as follows.

Figure 6:
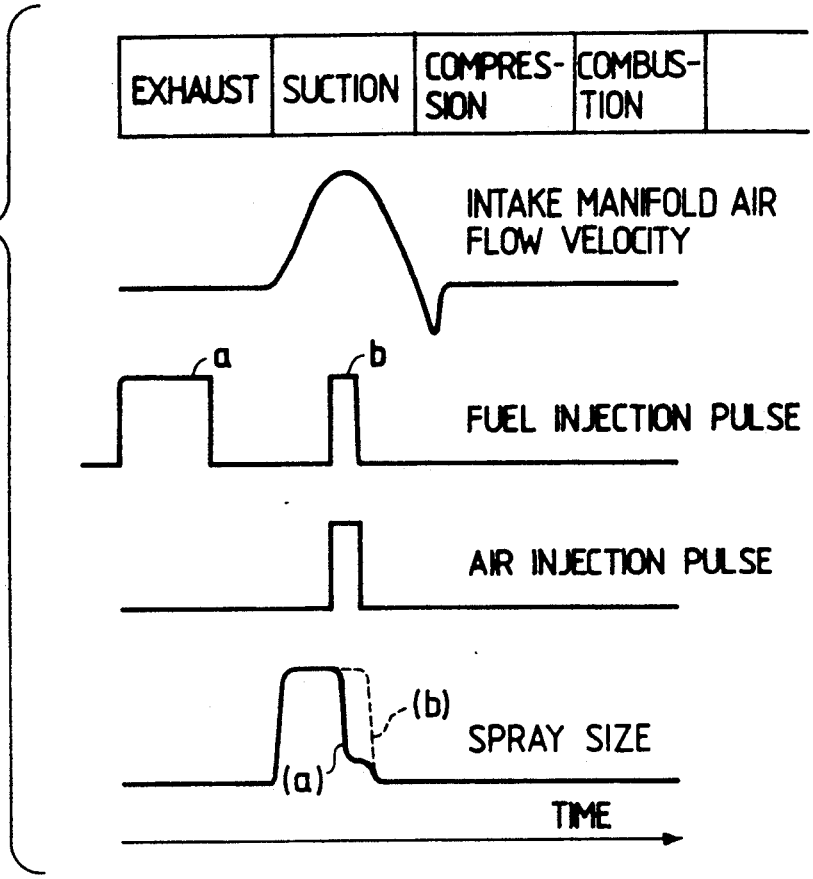
FIG. 6 shows various timing charts for explaining an operation of a further embodiment of a fuel injection control apparatus according to the present invention.

FIG. 6 shows another embodiment of the fuel injection control apparatus using various timing charts according to the present invention. The mechanical structure of the fuel injection control apparatus shown in FIG. 6 is the same as that shown in FIG. 1.

In this embodiment of the present invention, the droplet diameter distribution of the gasoline spray is controlled by dividing the fuel injection into two parts occurring at different times using the fuel injector 6 in each combustion cycle of the engine 1 having four strokes. Namely, the fuel injection pulse occurs at the (a) portion and (b) portion in the fuel injection pulse timing chart shown in FIG. 6.

In this embodiment of the present invention, both the valve opening timing of the fuel injector 6 and the valve opening timing of the electro-magnetic air valve 8 are controlled respectively in accordance with the injection timing charts shown in FIG. 6.

As clearly understood from this figure, a first time valve opening (a) portion of the fuel injector 6 is carried out during the exhaust stroke, and at this time since the air intake valve 11 is closed, so much fuel, which is injected through the fuel injector 6, is adhered to the air intake valve 11.

After that, in the intake manifold 3 during the suction stroke, the previously injected fuel spray having a droplet size of about 80–100 μm is carried by the air flow surrounding the air intake valve 11 and is sucked into the cylinder.

Next, the fuel injection at a second time valve opening (b) portion is carried out during the suction stroke, and at this time since the electro-magnetic air valve 8 is opened simultaneously, an air-fuel mixture having a droplet diameter of about 40 μm in a gasoline spray, is sucked into the cylinder.

In the gasoline spray size in FIG. 6, a solid curve line (a) indicates the gasoline spray size provided by the present invention, and a chain curve line (b) indicates the gasoline spray size in the conventional fuel injection control apparatus.

As a result, at the surrounding portion of the spark plug 10, an air-fuel mixture having a droplet diameter of about 40 μm in the gasoline spray, which has a comparative good ignition characteristic property, exists. And further, in the vicinity of the wall surface in the combustion chamber, an air-fuel mixture having a droplet diameter of about 80–100 μm in the gasoline spray, which has a comparatively bad ignition characteristic property, exists. Accordingly, the high compression ratio for the engine 1 can be obtained effectively while restraining the occurrence of knocking.

Figure 7:
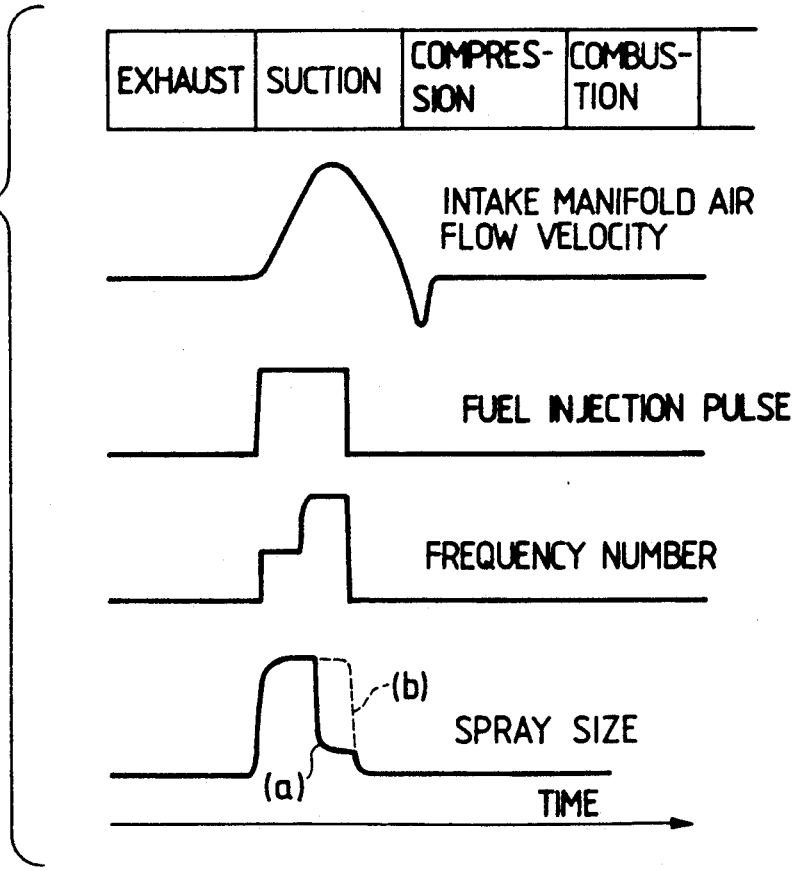
FIG. 7 shows various timing charts for explaining an operation of a still further embodiment of a fuel injection control apparatus according to the present invention.
Figure 8:
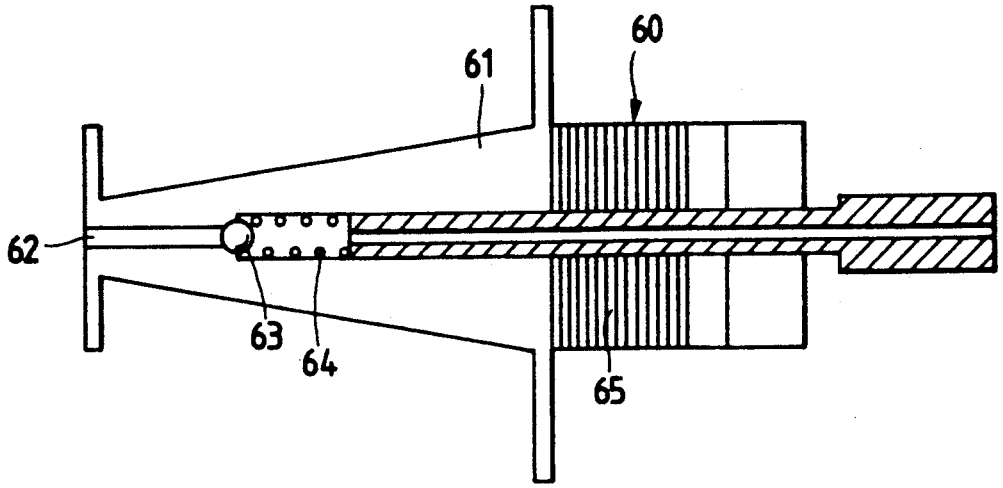
FIG. 8 is a partial cross-sectional view showing another embodiment of a fuel injector for use in a fuel injection control apparatus according to the present invention.

Next, FIG. 7 shows a further embodiment of the fuel injection control apparatus using various timing charts according to the present invention in which the fuel injector such as shown in FIG. 8 is used so as to make it possible to control the droplet size of the gasoline spray, and by this fuel injector the droplet size distribution of the gasoline spray is controlled.

In the gasoline spray size in FIG. 7, a solid curve line (a) indicates the gasoline spray size provided by the present invention, and a chain curve line (b) indicates the gasoline spray size in the conventional fuel injection control apparatus.

FIG. 8 shows one embodiment of such a fuel injector in which the droplet size distribution of the gasoline spray is controlled. As shown in FIG. 8, the fuel injector 60 makes use of a vibration of a piezo-electric element 65, and only when a horn portion 61 of the fuel injector 60 is subjected to a resonance condition is the fuel injected through a nozzle portion 62 and atomized. The horn portion 61 includes a ball valve 63 and a pressing spring member 64. The horn portion 61 can be driven by varying the frequency of vibration, so that the horn portion 61 can present a resonance condition, for example, at 30 $KH_z$, or at 60 $KH_z$.

And further, by varying the frequency of the horn portion 61 of the fuel injector 60, the droplet size of the gasoline spray can vary, for example, it can produce a droplet diameter of about 100 μm at 30 $KH_z$ and it can produce a droplet diameter of about 40 μm at 60 $KH_z$.

Figure 9:
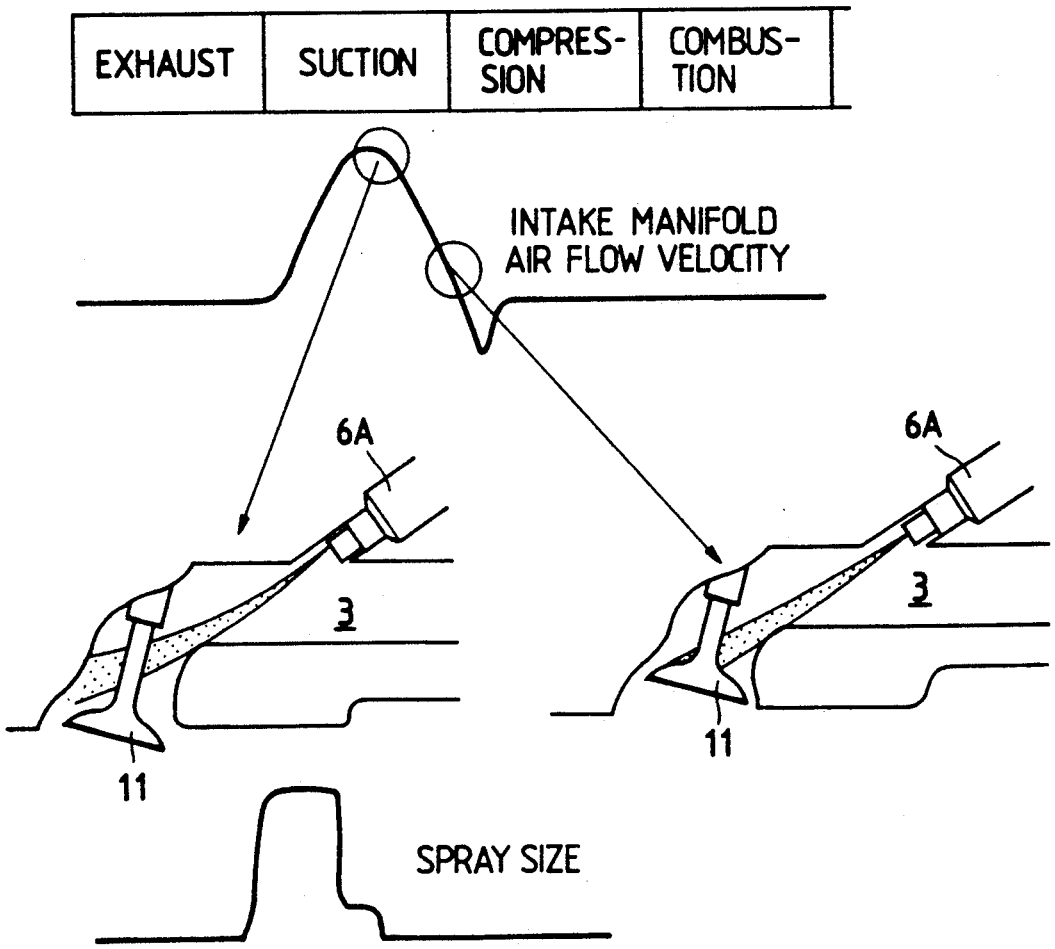
FIG. 9 shows various timing charts and an explanatory view for explaining an operation of still another embodiment of a fuel injection control apparatus according to the present invention.

FIG. 9 shows another embodiment of the fuel injection control apparatus according to the present invention. In this embodiment of the present invention, a swirl type fuel injector 6A is used as a fuel injector. The swirl type fuel injector 6A can give a swirling flow to the fuel and cause it to assume a thin film state.

This swirl type fuel injector 6A has been known already. By use of this swirl type fuel injector 6A, when the fuel is injected during the suction stroke, the gasoline spray is crushed by the air flow velocity in the intake manifold 3 and combined into the air flow stream, and then the combined gasoline spray is changed to a gasoline spray having a large droplet size.

Accordingly, when the fuel injection timing is carried out during the suction stroke, the gasoline spray is crushed by the air flow at a former half period of the fuel injection period and becomes a gasoline spray having a large droplet size. And at a latter half period of the fuel injection period, when the intake manifold air velocity is low, since the gasoline spray becomes a spray having a small droplet size which is not influenced significantly by the air flow, the droplet size distribution of the gasoline spray in the cylinder can be controlled.

Namely, the gasoline spray having a droplet diameter of about 40 μm is formed at the surrounding portion of the spark plug 10, and also the gasoline spray having a droplet diameter of more than 100 μm, is formed at a remote portion spaced from the spark plug 10, whereby the compression ratio for the engine 1 can be increased without the occurrence of knocking.

Figure 10:
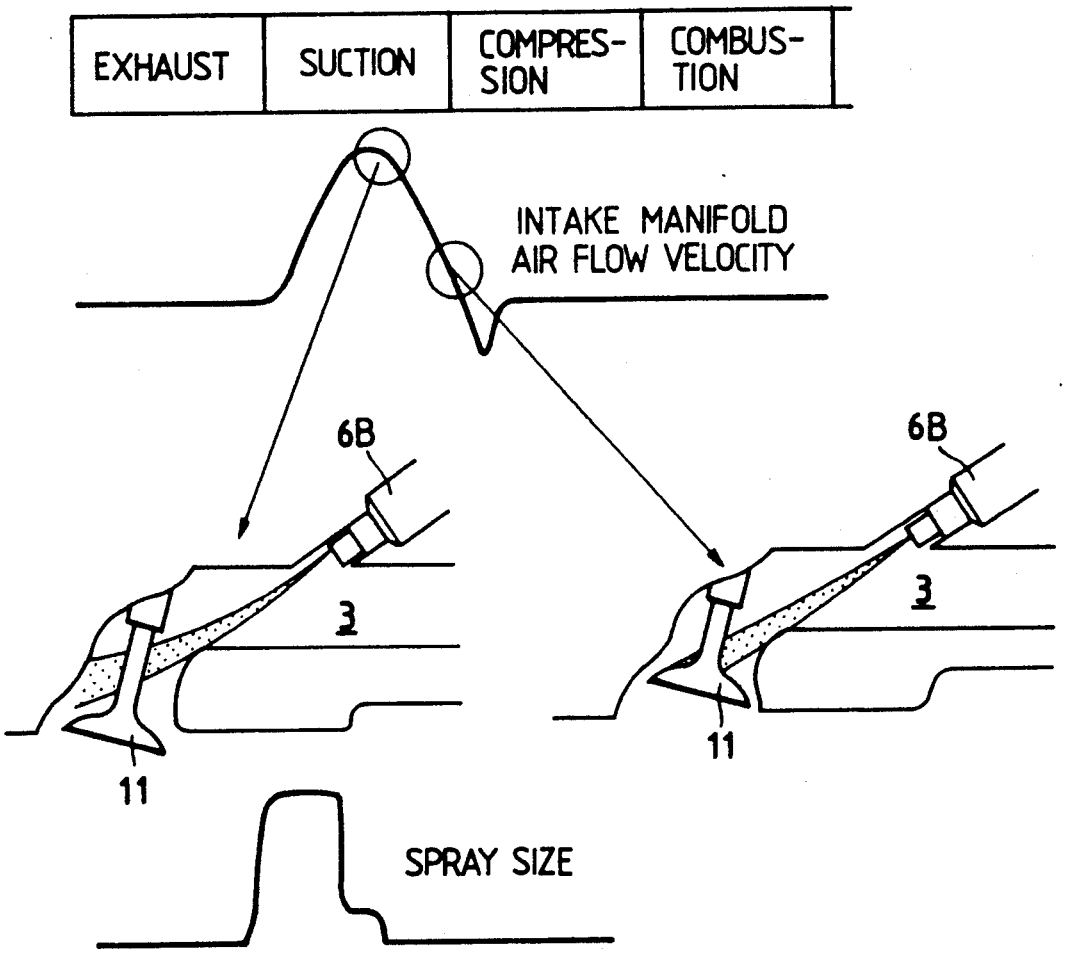
FIG. 10 shows various timing charts and an explanatory view for explaining an operation of a further embodiment of a fuel injection control apparatus according to the present invention.

FIG. 10 shows a further embodiment of the fuel injection control apparatus according to the present invention. In this embodiment of the present invention, a conventional pintle type fuel injector 6B is used as a fuel injector.

When this pintle type fuel injector 6B is used in the fuel injection control apparatus, by the air flow velocity in the intake manifold 3, the fuel is adhered to the upper surface of the intake manifold 3 at a former half period of the fuel injection period and the gasoline spray becomes a spray having a large droplet size.

And, at a latter half period of the fuel injection period, since the gasoline spray becomes a spray having a small droplet size which is little influenced by the air flow, the droplet size distribution of the gasoline spray in the cylinder can be controlled.

Figure 11A:
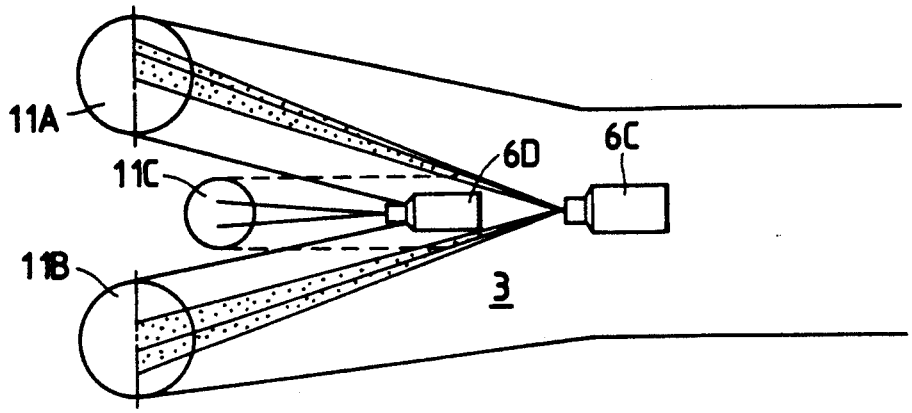
FIG. 11A is an explanatory view showing a structural relationship between a fuel injector and air intake valves.
Figure 11B:
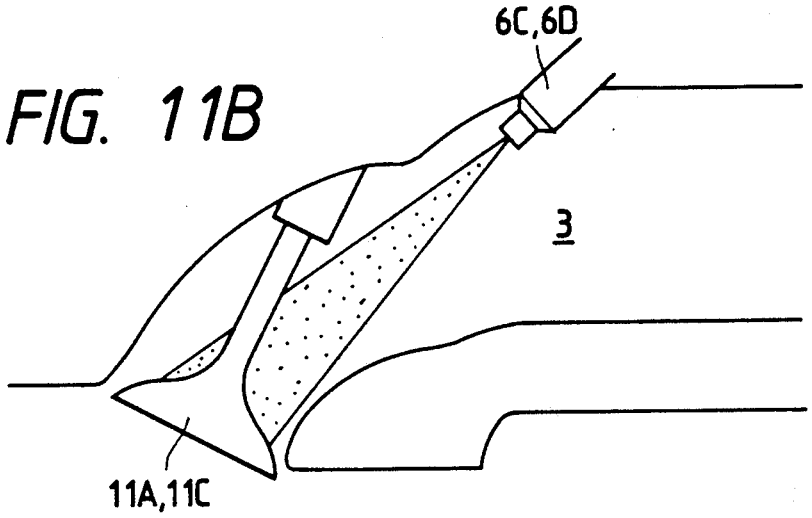
FIG. 11B is an explanatory view showing another structural relationship between a fuel injector and air intake valves.

FIG. 11A and FIG. 11B show a further embodiment of the fuel injection control apparatus according to the present invention. In this embodiment of the present invention, a droplet size control means for the gasoline spray comprises a two hole type fuel injector 6C, a pintle type fuel injector 6D, a first air intake valve 11A, a second air intake valve 11B, and a third air intake valve 11C.

Figure 12:
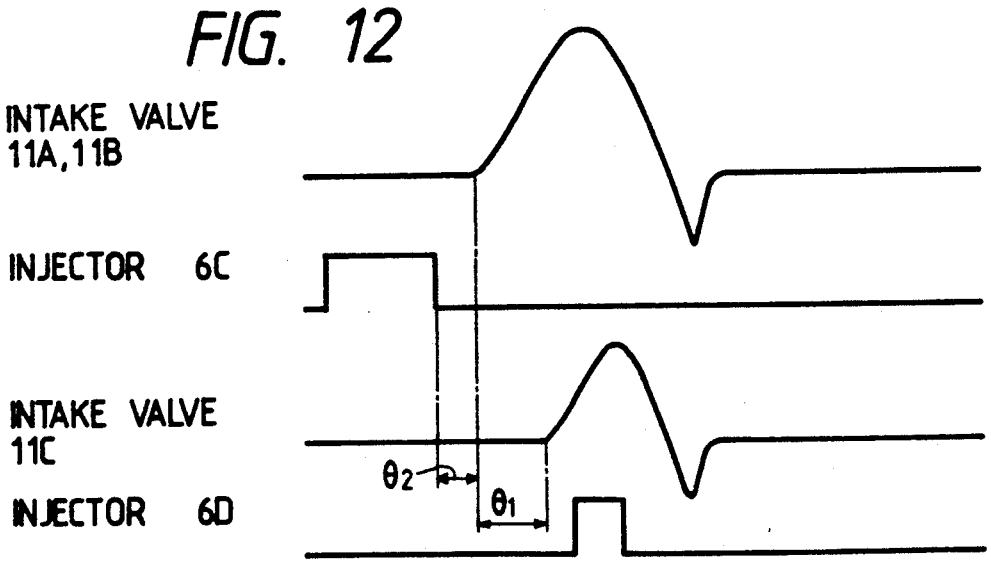
FIG. 12 shows various timing charts for explaining an operation of still a further embodiment of a fuel injection control apparatus according to the present invention.

In this embodiment of the present invention, as shown in the timing charts in FIG. 12, before the valve openings of the first air intake valve 11A and the second air intake valve 11B, the fuel is injected through the two hole type fuel injector 6C. For example, following operation of the injector 6C by a crank angle $\theta_2$ (about several degrees), the first air intake valve 11A and the second air intake valve 11B are opened, respectively.

And, at a latter half of the opening valve periods of the first air intake valve 11A and the second air intake valve 11B, for example by a crank angle $\theta_1$ (about 15 degrees), the third air intake valve 11C is opened, and the fuel is injected through the second fuel injector 6D.

Tn this way the droplet size distribution of the gasoline spray in the cylinder in the embodiment can be controlled similar to the above stated embodiments of the present invention.

Figure 13:
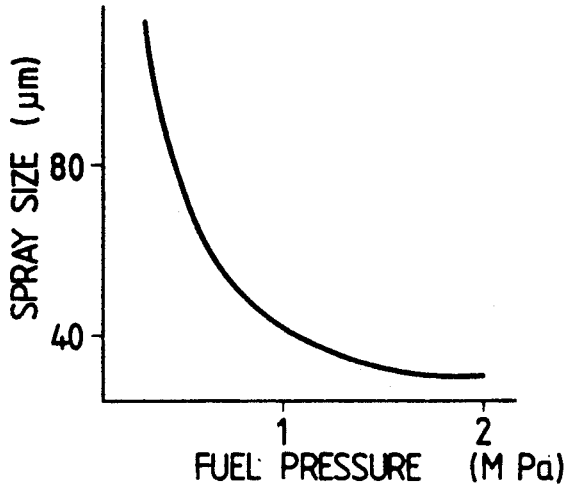
FIG. 13 is a characteristic view showing the relationship between fuel pressure and droplet size in a gasoline spray.

Besides, the droplet size of the gasoline spray, which is injected through the fuel injectors 6C and 6D, varies as shown in FIG. 13 in accordance with the fuel pressure (the pressure of the fuel such as gasoline etc. being supplied into the fuel injector).

Figure 14:
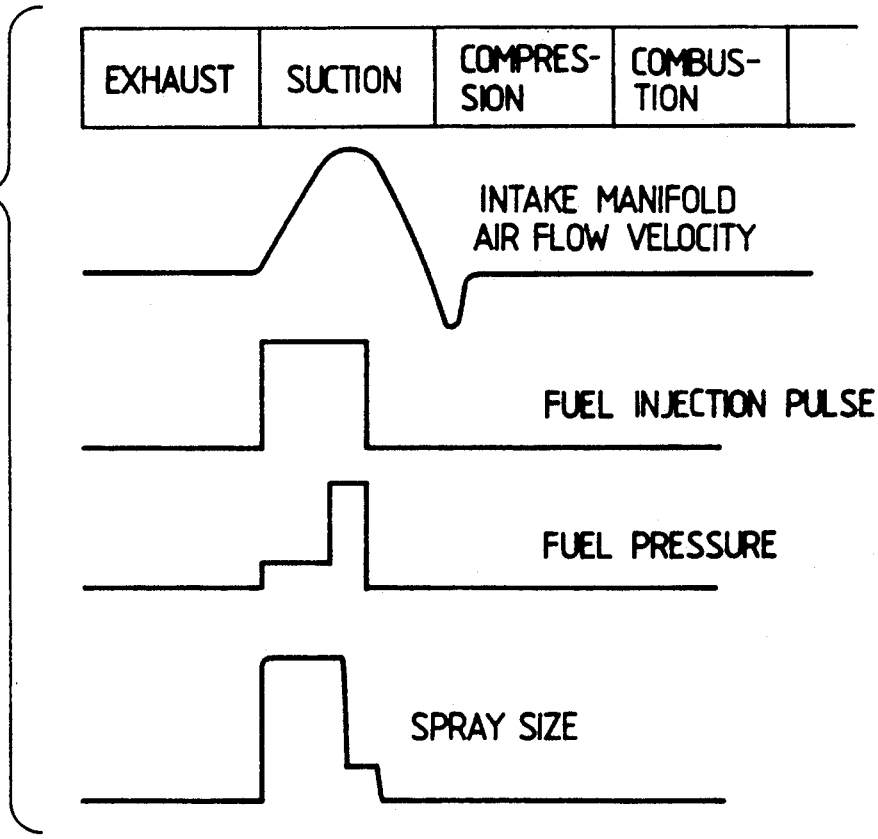
FIG. 14 shows various timing charts for explaining an operation of yet a further embodiment of a fuel injection control apparatus according to the present invention.

FIG. 14 shows yet another embodiment of the fuel injection control apparatus using various timing charts according to the present invention. In this embodiment of the present invention, as shown in the timing charts in FIG. 14, since the fuel pressure is varied at two stages during the fuel injection period, the droplet size distribution of the gasoline spray in the cylinder can be controlled.

Figure 15:
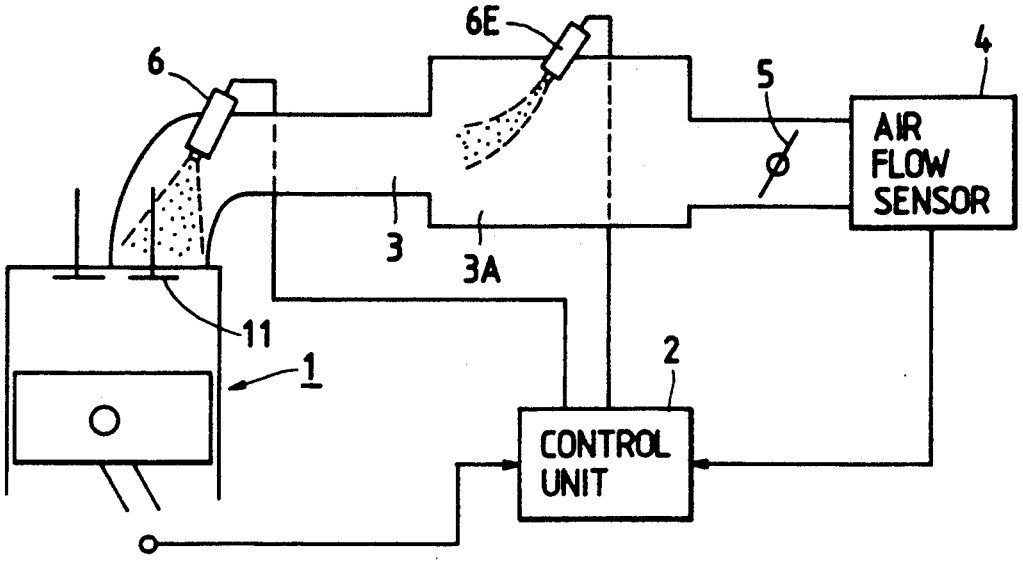
FIG. 15 is a block diagram showing a further embodiment of a fuel injection control apparatus using a plurality of fuel injectors according to the present invention.

FIG. 15 shows a further embodiment of the fuel injection control apparatus according to the present invention. In this embodiment of the present invention, in regard to the fuel injector 6 which is arranged in the vicinity of the air intake valve 11, and another fuel injector 6E is added to a controller portion 3A of the intake manifold 3.

Figure 16:
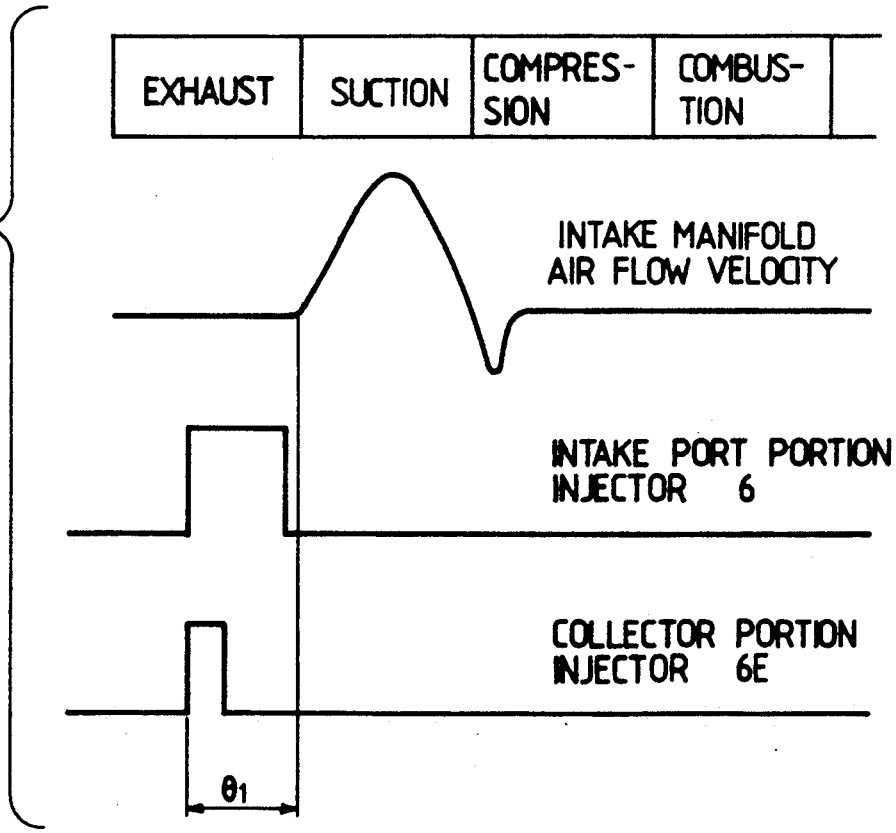
FIG. 16 shows various timing charts for explaining an operation of yet another embodiment of a fuel injection control apparatus according to the present invention.

These two fuel injectors 6 and 6E are operated respectively according to the fuel injection timing charts shown in FIG. 16. The fuel is injected through the fuel injector 6E according to the fuel injection timing chart, for example, at a crank angle $\theta_1$ (about 40 degree) before the suction stroke.

Since the air-fuel mixture, which is sucked into the cylinder during the suction stroke, combines the air-fuel mixture through the fuel injector 6 and the air-fuel mixture through the fuel injector 6E, the droplet size distribution of the gasoline spray in the cylinder is controlled. The air-fuel mixture having a good ignition characteristic property is formed at the vicinity of the spark plug 10, whereby a high compression ratio for the engine 1 can be obtained while restraining the occurrence of knocking.

Figure 17:
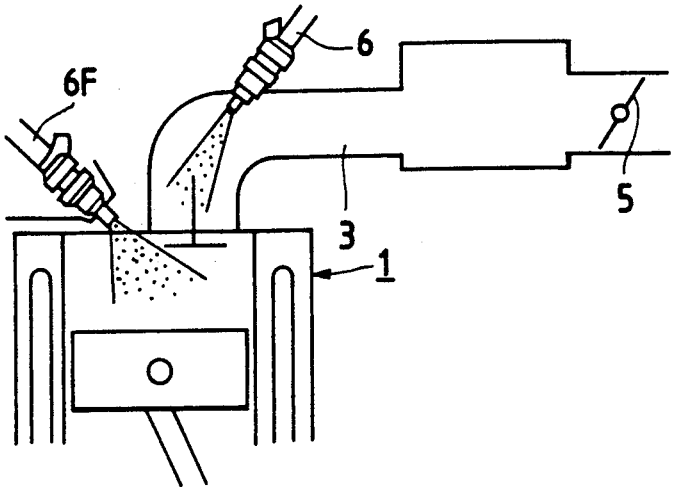
FIG. 17 is a structural view showing a further embodiment of a fuel injection control apparatus using a fuel injector disposed in a cylinder according to the present invention.

FIG. 17 shows a further embodiment of the fuel injection control apparatus according to the present invention. In this embodiment of the present invention, the fuel injector 6 is disposed in the vicinity of the air intake port portion of the engine 1, and further another fuel injector 6F is disposed in the engine 1, this fuel injector fuel 6F can inject directly into the cylinder.

With the fuel injection into the cylinder, the atomized fuel is hardly adhered to the intake manifold 3, thereby it is possible to control easily the distribution of the droplet size of the gasoline spray. At a former half period of the suction stroke, the fuel is supplied through the fuel injector 6 disposed at the air intake port portion, and after that the fuel is supplied through the fuel injector 6F disposed in the cylinder, whereby a distribution having a predetermined droplet size of the gasoline spray can be controlled.

Figure 18:
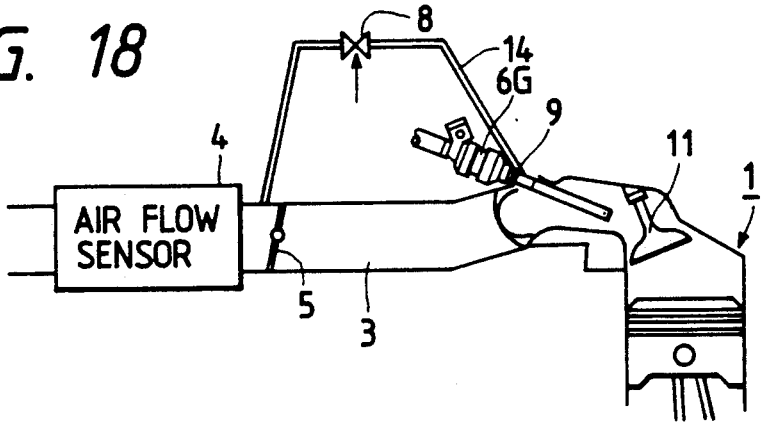
FIG. 18 is a structural view showing a further embodiment of a fuel injection control apparatus using a fuel injector having a target portion according to the present invention.

FIG. 18 shows another embodiment of the fuel injection control apparatus according to the present invention. In this embodiment of the present invention, a fuel injector 6G is disposed in the vicinity of the air intake valve 11, and an air flow passage 14 is connected from the upper-stream side of the throttle valve 5 through the electro-magnetic air valve 8 to this fuel injector 6G.

Figure 19A:
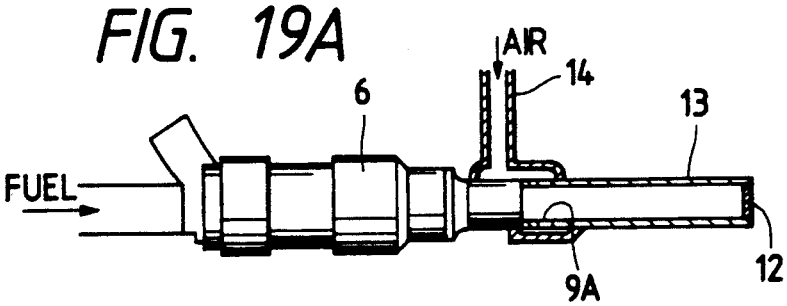
FIG. 19A is a structural view showing a further embodiment of a fuel injector having a target portion according to the present invention.
Figure 19B:
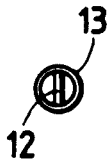
FIG. 19B is a side view showing one embodiment of the fuel injector having a target portion according to the present invention.

The structure for the fuel injector 6G of the fuel injection control apparatus is shown in FIG. 19. A target portion 12 of the fuel injector 6G is provided in a front side of a fuel outlet nozzle of the fuel injector 6G and is fixed to a cover 13. The target portion 12 of the fuel injector 6G acts as a fuel diffusion member for diffusing the fuel in the fuel injection direction.

In this structure of the fuel injector 6G, the cross-sectional shape of the target portion 12 is made a column shape or a tri-angular shape. The cover 13 is made of a column shape stainless material or a column shape anti-thermal resin material. A nozzle hole portion 9A is provided at the tip of the cover 13, and the air flow passage 14 is connected to the nozzle hole portion 9A.

The fuel which passes the nozzle hole portion 9A collides with the air passing to the target portion 12 and atomized, and is further the fuel is atomized by the target portion 12.

Figure 20:
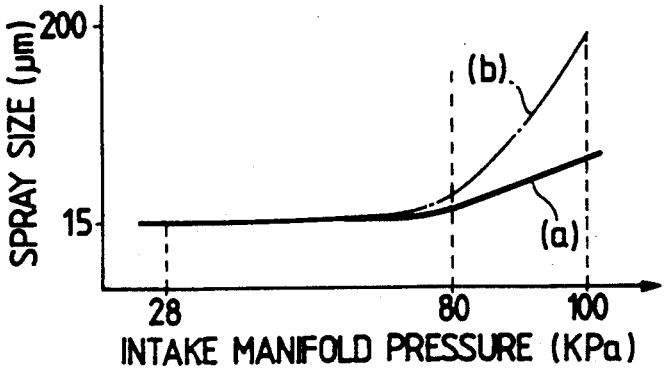
FIG. 20 is a characteristic view showing a relationship between intake manifold pressure and droplet size in a gasoline spray.

FIG. 20 shows a relationship between the droplet size of the gasoline spray injected from the fuel injector 6G and the intake manifold pressure in the intake manifold 3.

In case that the target portion 12 is not provided on the fuel injector 6G, as shown in a chain curve line (b) in FIG. 20, when the intake manifold pressure is 100 $KP_a$, namely when the throttle valve 5 is fully-opened, and this intake manifold pressure closes to the atmospheric pressure, the air does not flow into the air flow passage 14, then the fuel atomization by the air can not carried out, accordingly the droplet size of the gasoline spray becomes large.

Besides, in case that the target portion 12 is provided on the fuel injector 6G, as shown in a solid curve line (a) in FIG. 20, at the vicinity of the intake manifold pressure having 100 $KP_a$, when the fuel injection pule width $T_i$ becomes large, the force of the fuel, which is injected through the nozzle hole portion 9A, becomes large by the course of events. The fuel is atomized easily at the target portion 12, and the gasoline spray has a small droplet size.

Further, at the intake manifold pressure of 28 $KP_a$, the fuel atomization can be carried out easily according to the air flow, thereby the droplet size of the gasoline spray can be maintained small.

According to this embodiment of the present invention, since even if the fuel adheres to the target portion 12 of the fuel injector 6G during the idling operation, the adhered fuel is blown off by the air flow, the fuel does not fall, then the fuel is supplied smoothly into the engine 1, whereby the idling operation for the engine 1 can be stabilized.

In this embodiment of the present invention, the fuel is injected during the suction stroke, the electro-magnetic air valve 8 is opened at a latter half period of the suction stroke, and the electro-magnetic air valve 8 is closed at a former half period of the suction stroke.

The atomizing gasoline spray having a droplet diameter of about 15–40 μm is formed at the surrounding portion of the spark plug 10. And, the atomizing gasoline spray having a droplet diameter which is comparatively large is formed at the remote portion of the spark plug 10. Accordingly, the knocking occurrence can be restrained and a high compression ratio for the engine 1 can be obtained easily.

We claim:

1. A fuel injection control apparatus for use in a fuel injection system of a internal combustion engine, comprising means for providing various data indicating operational conditions of the internal combustion engine, a control unit for carrying out a predetermined calculation in accordance with the various data to calculate a necessary fuel injection amount, at least one fuel injector controlled by said control unit for supplying the fuel injection amount into a cylinder of the internal combustion engine and a fuel spray size distribution control means for controlling the distribution of the spray size of an air-fuel mixture in the cylinder so that the spray size of the fuel in the vicinity of the spark plug disposed in the cylinder is smaller than the spray size of fuel in the vicinity of a wall surface of the combustion chamber.

2. A fuel injection control apparatus according to claim 1, wherein said fuel spray size distribution control means comprises a fuel injector driving means for operating said fuel injector during a suction stroke of the engine and an air injection means for injecting air in the vicinity of an injection port of said fuel injector at a predetermined air injection timing.

3. A fuel injection control apparatus according to claim 2, wherein said fuel injector driving means carries out fuel injection in two periods occurring during an exhaust stroke of the engine and the suction stroke of the engine, respectively.

4. A fuel injection control apparatus according to claim 1, wherein said fuel injector has a piezo-electric element for controlling droplet diameter, and said fuel spray size distribution control means comprises control means for controlling the fuel spray size by driving a piezoelectric element at least at two different frequencies during the fuel injection period, thereby controlling at a predetermined fuel injection timing the spray size of the fuel which is injected through said fuel injector during the duration of fuel injection.

5. A fuel injection control apparatus according to claim 1, wherein said fuel injector is a swirl type fuel injector, and said fuel spray size distribution control means comprises fuel injector driving means for operating said swirl type fuel injector at least two times during every suction stroke of the engine.

6. A fuel injection control apparatus according to claim 1, wherein said fuel injector is a pintle type fuel injector, and said fuel spray size distribution control means comprises fuel injector driving means for operating said pintle type fuel injector at least two times during every suction stroke of the engine.

7. A fuel injection control apparatus according to claim 1, wherein a first fuel injector and a second fuel injector is provided for supplying fuel to a cylinder of the engine, said first fuel injector and said second fuel injector each having a different spray size characteristic under the same fuel pressure, and wherein said first spray size distribution control means comprises means for controlling individually a first fuel injection to said cylinder using said first fuel injector at a first injection time and a second fuel injection to said cylinder using said second fuel injector at a second injection time.

8. A fuel injection control apparatus according to claim 1, wherein said fuel spray size distribution control means comprises control means for controlling fuel pressure in said fuel injector so as to change the fuel pressure at a predetermined timing during the fuel injection pulse.

9. A fuel injection control apparatus according to claim 1, wherein a first fuel injector and a second fuel injector are provided for supplying fuel to a cylinder of the engine, said first fuel injector and said second fuel injector being disposed respectively at a different distance from an air intake valve in an air intake passage of the engine, and wherein said fuel spray size distribution control means comprises means for controlling individually a first fuel injection to said cylinder using said first fuel injector with a first injection duration and a second fuel injection to said cylinder using said second fuel injector with a second injection duration.

10. A fuel injection control apparatus according to claim 1, wherein a first fuel injector for injecting a fuel into the cylinder and a second fuel injector for injecting a fuel into an intake manifold of the engine are provided, and wherein said fuel spray size distribution control means includes means for individually controlling a first fuel injection timing of said first fuel injector and a second fuel injection timing of said second fuel injector.

11. A fuel injection control apparatus according to claim 2, wherein said fuel injector has a fuel injection diffusion member for diffusing fuel toward a fuel injection direction of an injecting nozzle of said fuel injector.

12. A fuel injection control apparatus for use in a fuel injection system of an internal combustion engine, comparing means for providing various data indicating operational conditions of the internal combustion engine, a control unit for carrying out a predetermined calculation in accordance with the various data to calculate a necessary fuel injection amount, at least one fuel injector controlled by said control unit for supplying the fuel injection amount into a cylinder of the internal combustion engine, droplet diameter control means for controlling the droplet diameter in a gasoline spray in an air-fuel mixture provided by said fuel injector in the cylinder, and air injection means for injecting air in the vicinity of an injection port of said fuel injector with a predetermined air injection timing during a suction stroke of the gasoline engine, said droplet diameter control means including means for controlling the gasoline spray of fuel so that the droplet diameter of fuel in the vicinity of the spark plug is smaller than the droplet diameter in the vicinity of a wall surface of the cylinder.

13. A fuel injection control apparatus according to claim 12, wherein said fuel injector injects fuel during the exhaust stroke of the gasoline engine and the suction stroke of the gasoline engine.

14. A fuel injection control apparatus according to claim 12, wherein said fuel injector includes a piezoelectric element.

15. A fuel injection control apparatus according to claim 12, wherein said fuel injector is a swirl type fuel injector, and said swirl type fuel injector injects fuel into the cylinder two times during every suction stroke of the gasoline engine.

16. A fuel injection control apparatus according to claim 12, wherein said fuel injector is a pintle type fuel injector, and said pintle type fuel injector injects fuel into the cylinder two times during every suction stroke of the gasoline engine.

17. A fuel injection control apparatus according to claim 12, wherein a first fuel injector and a second fuel injector are provided for supplying fuel to a cylinder of the engine, each of said first fuel injector and said second fuel injector having a different droplet diameter characteristic under the same fuel pressure, and wherein said droplet diameter control means includes means for controlling each of said first fuel injector and said second fuel injector individually in accordance with a first fuel injection to said cylinder using said first fuel injector at a first injection time and a second fuel injection to said cylinder using said second fuel injector at a second injection time.

18. A fuel injection control apparatus according to claim 12, wherein said droplet diameter control means comprises fuel pressure control means for controlling fuel pressure of said fuel injector so as to change the fuel pressure at a predetermined timing during the fuel injection pulse.

19. A fuel injection control apparatus according to claim 12, wherein a first fuel injector and a second fuel injector are provided for supplying fuel to a cylinder of the engine, each of said first fuel injector and said second fuel injector being disposed at a different distance from an air intake valve in an air intake passage of the gasoline engine, and wherein said droplet diameter control means includes means for controlling each of said first fuel injector and said second fuel injector individually in accordance with a first fuel injection to said cylinder using said first fuel injector with a first injection duration and a second fuel injection to said cylinder using said second fuel injector with a second injection duration.

20. A fuel injection control apparatus according to claim 12, wherein a first fuel injector and a second fuel injector are provided, said first fuel injector being disposed to inject fuel into a cylinder, said second fuel injector being disposed to inject fuel into an intake manifold of the wherein said droplet diameter control means includes means for controlling engine, and each of said first fuel injector and said second fuel injector individually in accordance with a first fuel injection timing of said first fuel injector and a second fuel injection timing of said second fuel injector.

21. A fuel injection control apparatus according to claim 12, wherein said fuel injector includes a fuel injection diffusing member, and said fuel injection diffusing member diffuses fuel toward a fuel injection direction of an injecting nozzle of said fuel injector.

22. A fuel injection control apparatus according to claim 12, wherein said droplet diameter control means controls the droplet diameter of the gasoline spray at about 40 μm in a vicinity of a discharge electrode of the spark plug.

23. A fuel injection control apparatus according to claim 1, wherein said fuel spray size distribution control means controls the spray size of the fuel at about μm at the vicinity of a discharge electrode of the spray plug.

24. A fuel injection control apparatus according to claim 1, wherein said fuel spray size distribution control means includes air injection means for injecting air in the vicinity of an injection port of the fuel injector for only a portion of the fuel injection period so that the droplet diameter of the gasoline spray produced at a first portion of the fuel injection period is larger than the droplet diameter of the gasoline spray produced during the remaining portion of the fuel injection period.

25. A fuel injection control apparatus according to claim 3, wherein said fuel spray size distribution control means includes air injection means for injecting air in the vicinity of an injection port of the fuel injector for only the period of fuel injection which occurs during the suction stroke of the engine.

26. A fuel injection control apparatus according to claim 9, wherein said first injection duration and said second injection duration overlap and occur during the exhaust stroke of the engine.

* * * * *